United States Patent [19]

Feld et al.

[11] 4,365,493

[45] Dec. 28, 1982

[54] SHOT PEENING APPARATUS

[75] Inventors: Paul G. Feld, Los Angeles; Richard M. Engel, Cypress, both of Calif.

[73] Assignee: Metal Improvement Company, Inc., Paramus, N.J.

[21] Appl. No.: 272,337

[22] Filed: Jun. 10, 1981

[51] Int. Cl.[3] ..... B21J 1/00; C21D 7/06

[52] U.S. Cl. ..... 72/53

[58] Field of Search ..... 72/53, 40; 209/44.2; 51/425, 410, 428, 439

[56] References Cited

U.S. PATENT DOCUMENTS

| | | | |
|---|---|---|---|
| 2,933,802 | 4/1960 | Fuchs | 72/53 |
| 3,242,616 | 3/1966 | Haider | 72/53 |
| 3,421,618 | 1/1969 | Burney | 209/44.2 |
| 3,426,563 | 2/1969 | Burney | 72/53 |
| 3,705,511 | 12/1972 | Brandel | 72/53 |
| 4,067,240 | 1/1978 | Straub | 72/53 |

*Primary Examiner*—Gene Crosby

*Attorney, Agent, or Firm*—Arthur L. Frederick

[57] ABSTRACT

The shot peening apparatus for shot peening the surface of a workpiece has a gravity shot distribution subassembly which includes deflectors which utilize the kinetic energy in the falling shot to effect a substantially uniform distribution of shot into a conduit for conducting the shot at gravitational velocity to an elongated nozzle. Associated with the nozzle is a plenum communicating with the nozzle and containing a gaseous fluid under a relatively low static pressure for accelerating the shot out of said nozzle at higher than gravitational velocity for impact against a workpiece.

14 Claims, 7 Drawing Figures

SHOT PEENING APPARATUS

This invention relates to shot peening apparatuses and, more particularly, to shot peening apparatuses capable of providing usable peening intensity over a large surface of a workpiece.

BACKGROUND OF THE INVENTION

It has been found desirable for producing relatively smoothly peened surfaced workpieces and/or for shaping workpieces, such as metal sheet, plate or structural members, by shot peening to achieve such shot peening by propelling shot under low pressure air and/or gravity forces. Such peening process and apparatuses are exemplified in the U.S. Patent to Brandel etl al U.S. Pat. No. 3,705,511. However, it has been found that relying solely on gravity for propelling the shot has posed problems of suitability of the peening apparatus for a wide range of different workpiece materials because the velocity of the shot could not be varied commensurate with the kind of material to be shot peened and/or type of shot peening to be accomplished. The present invention is directed to overcoming this disadvantage.

It is, therefore, an object of this invention to provide a shot peening apparatus which is capable of providing shot peening over a wide range of different workpiece materials.

It is another object of the present invention to provide a shot peening apparatus capable of providing substantially uniform distribution of shot along a relative great flow area simply and inexpensively.

It is a further object of this invention to provide a shot peening apparatus which can achieve shaping of workpieces over a wide range of types of workpieces than heretofore known air pressure or gravity shot peening devices.

A still further object of the present invention is to provide a shot peening apparatus in which substantially uniform distribution of falling shot is achieved in an inexpensive manner.

SUMMARY OF THE INVENTION

Accordingly, the present invention provides a novel shot peening apparatus comprising a guide duct means for conducting shot which has an upper inlet end portion and a lower outlet end portion. A gravity feed means is provided for receiving shot from a source of supply of such shot and for conveying and discharging shot by gravity. Interposed between the upper inlet end portion of the guide duct means and the gravity feed means is an impact means which utilizes a portion of the kinetic energy of the shot discharging from the gravity feed means to effect substantially uniform distribution of the shot in the guide duct means. A nozzle means is provided for receiving the substantially uniformly distributed shot from the lower outlet end portion of the guide means at substantially gravitational velocity and for directing the shot to impact against a workpiece.

In a narrower aspect of the invention, the shot peening apparatus includes a plenum means disposed adjacent said nozzle means and forming a plenum which contains a gaseous fluid at low static pressure for accelerating the shot in a direction out of said nozzle means. In this aspect of the invention and by controlling the amount of gaseous fluid pressure, the acceleration of and hence the impacting velocity of the shot can be varied as desired and commensurate with the material of which the workpiece is made and/or the particular requirements for shaping a workpiece for deformation (sometimes known as "peen forming").

A feature of this invention is a blower for supplying the gaseous fluid, such as air, in the plenum. The blower is driven by any suitable conventional variable speed motor so that air velocity entering the plenum at a low value, as for example 3000 fpm, is controllable to thereby vary the static pressure and, hence, the velocity thereof for accelerating the shot from the nozzle means.

Another feature of the present invention is the plurality of conduits making-up the gravity feed means, which conduits are arranged in side-by-side relationship to each other and a baffle means having a deflecting surface associated with each conduit to cause the shot discharging from each conduit to randomly ricochet into the guide duct means to thereby effect substantially uniform distribution of shot in the guide duct by utilization of some of the gravitational kinetic energy of the shot.

BRIEF DESCRIPTION OF THE DRAWINGS

The invention will be more fully understood from the following description when considered in connection with the accompanying drawings in which.

DESCRIPTION OF THE PREFERRED EMBODIMENT

Figure 1:
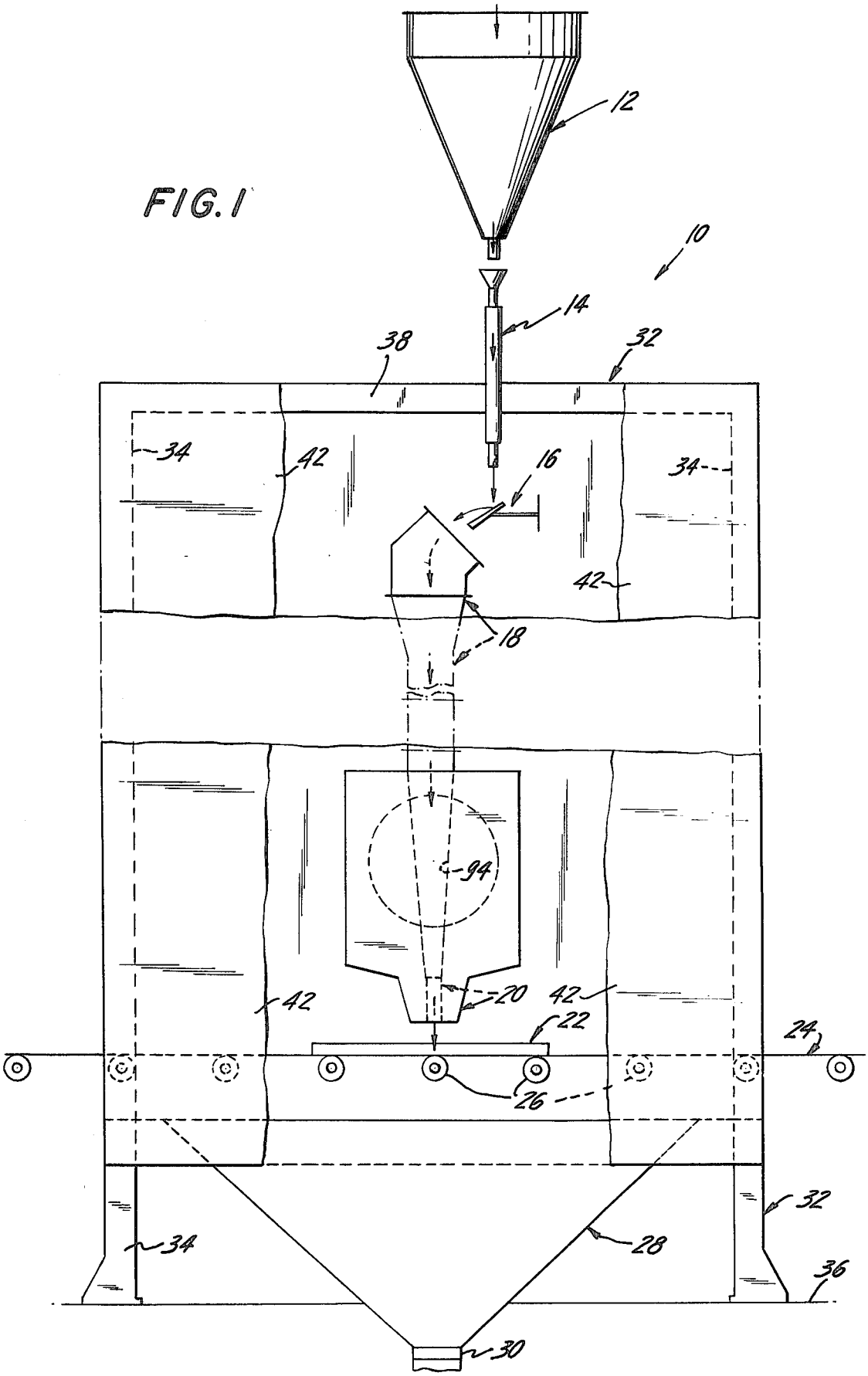
FIG. 1 is a schematic showing of the shot peening apparatus according to this invention.

Now, referring to the drawing and, more particularly, FIG. 1 thereof, the reference number 10 generally designates the shot peening apparatus according to this invention.

The apparatus 10 comprises, in general, source of shot which may be a supply hopper 12, a gravity shot distribution subassembly 14, which includes impact means 16 for effecting substantially uniform distribution of shot into a guide duct 18 and nozzle assembly 20 of elongated shape for receiving shot from duct 18 and discharging the shot to impact against the surface of a workpiece 22. A workpiece support means 24 is provided for supporting the workpiece 22 for shot peening and such support means may take the form of a roller supported conveyor or merely spaced, parallel rollers 26 or any other suitable supporting and conveying device. Disposed beneath workpiece support means 24 is a shot collecting hopper 28. The outlet 30 of hopper 28 is connected to a shot recirculation system, not shown, of any suitable type such as shown in the aforesaid U.S. Pat. No. 3,705,511, and the U.S. Patent to Fuchs, U.S. Pat. No. 2,933,802. The shot recirculation system (not shown) may include a shot classifying apparatus such as disclosed in the U.S. Patent to Burney et al U.S. Pat. No. 3,421,618. The shot recirculation system is connected to the supply hopper 12 to deliver recirculated shot to the hopper together with new shot which may be added to replace shot rejected by a shot classifier (not shown) that may form part of the shot recirculation system. The support of supply hopper 12, gravity shot distribution subassembly 14, nozzle 20 and recovery hopper 28, may be supported on a frame 32, the frame comprising a plurality of vertically extending columns 34 anchored in a foundation 36 and interconnected by joists 38 and a flooring 40 (see FIG. 3). The apparatus 10 may at least be partially enclosed by walls 42 attached to frame 32.

SUPPLY HOPPER

Figure 2:
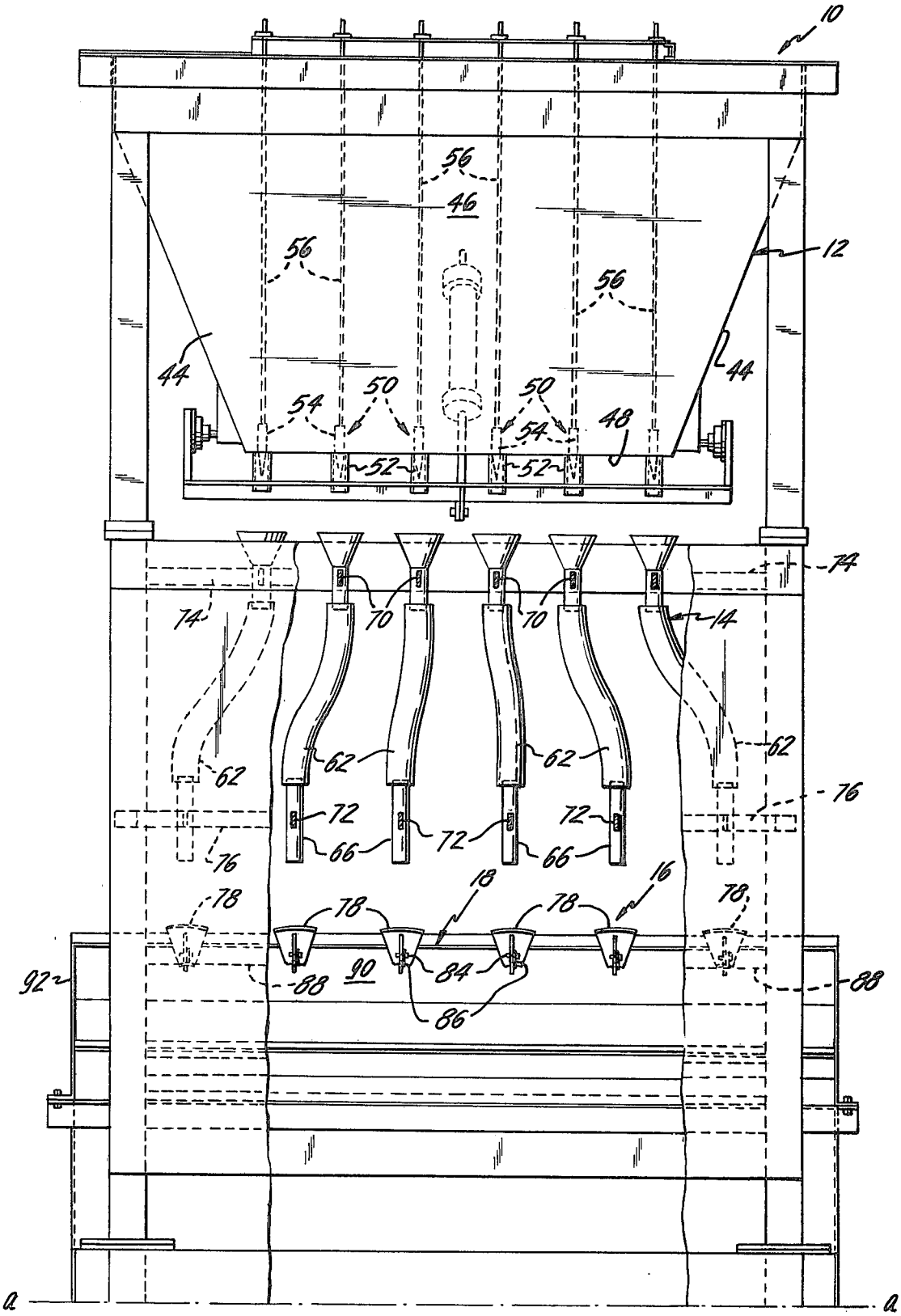
FIG. 2 is a front elevational view of the upper portion of the shot peening apparatus of FIG. 1 with parts broken away for illustration purposes only.
Figure 3:
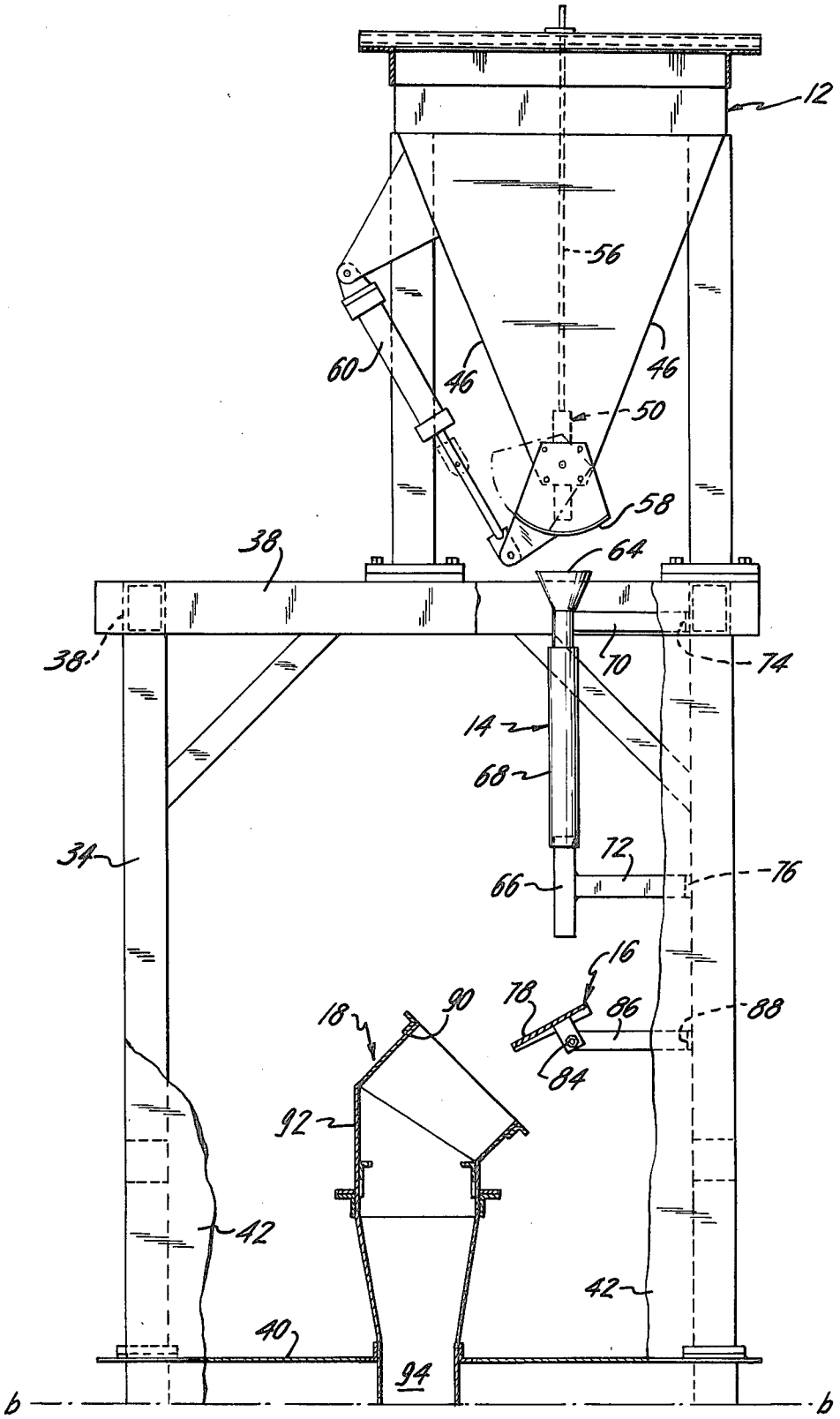
FIG. 3 is a side elevational view of the upper portion of the apparatus with parts broken away for illustration purposes only.

The supply hopper 12, as best shown in FIGS. 2 and 3, comprises contiguous inclined side walls 44 and inclined front and rear walls 46 which define therebetween an enclosure for retaining a supply of shot. The bottom of supply hopper 12 is closed by a wall 48. A plurality of spaced, parallel metering outlet valves 50 are supported in bottom wall 48 to effect initial distribution of shot along the front of apparatus 10. Each metering outlet valve 50 consists of a tubular outlet conduit 52 and a movable valve member 54 disposed for movement within outlet conduit 52. The value member 54 is supported at its upper end for linear movement by a bracket 56 secured to the hopper. Any suitable mechanism well known in the art may be employed to effect movement of each of the valve members 54 relative to their respective outlet conduits 52.

The flow of shot from each of the outlet metering valves 50 is controlled by a gate 58 which is pivotally secured to side walls 44 of supply hopper 12. Gate 58 is pivotally movable to and from the closed position shown in full lines in FIGS. 2 and 3 and the full-open position shown in broken lines in FIG. 3 by a linear motor 60 which may be of hydraulic or pneumatic type.

GRAVITY SHOT DISTRIBUTION SUBASSEMBLY

The gravity shot distribution subassembly 14 comprises a plurality of side-by-side conduits 62, one for each outlet metering valve 50 of supply hopper 12. Each conduit 62 comprises a funnel-shaped inlet member 64, a lower tubular outlet member 66 and an intermediate, flexible, tubular section 68 interconnecting the inlet and outlet members. Each of the funnel-shaped inlet members 64 is supported on a bracket 70 while each of the outlet members 66 is supported on a bracket 72. The brackets 70 and 72 are, respectively, secured to bars 74 and 76 which, in turn, are connected to columns 34 of frame 32. Each funnel-shaped inlet member 62 is disposed in vertical alignment with a metering valve 50 to receive shot released from the latter.

Figure 5:
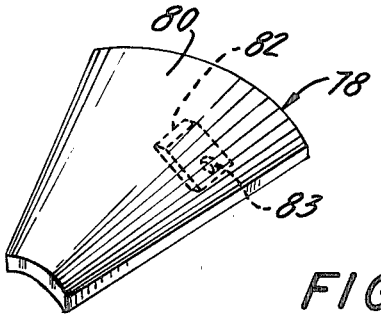
FIG. 5 is a perspective view of the deflector plates forming a component of the apparatus of this invention.

The impact means 16 comprises a plurality of deflector plates 78, one for each conduit 62 and disposed in the path of shot discharging from the conduits and between the conduits 62 and guide duct 18. As best shown in FIG. 5, each deflector plate 78 is fan-shaped in a top planar view and arcuate shaped in cross-section so as to provide an upper curved, impact surface 80 against which the falling shot strikes. Each deflector plate 78 has an ear 82 secured to and depending from the underside of the deflector plate. This ear 82 has a bolt hole 83 through which a bolt 84 passes to secure the deflector plate to the distal end portion of a bracket 86, which, in turn, is attached to a bar 88. The bar 88 is, similar to bars 74 and 76, secured to vertical columns 34 of frame 32. Each deflector plate 78 is pivotally adjustable on bracket 86 and secured in an adjusted position so that substantially all of the shot, impacting against its surface 80, ricochet into the elongated inlet opening 90 of guide duct 18.

GUIDE DUCT

Figure 3A:
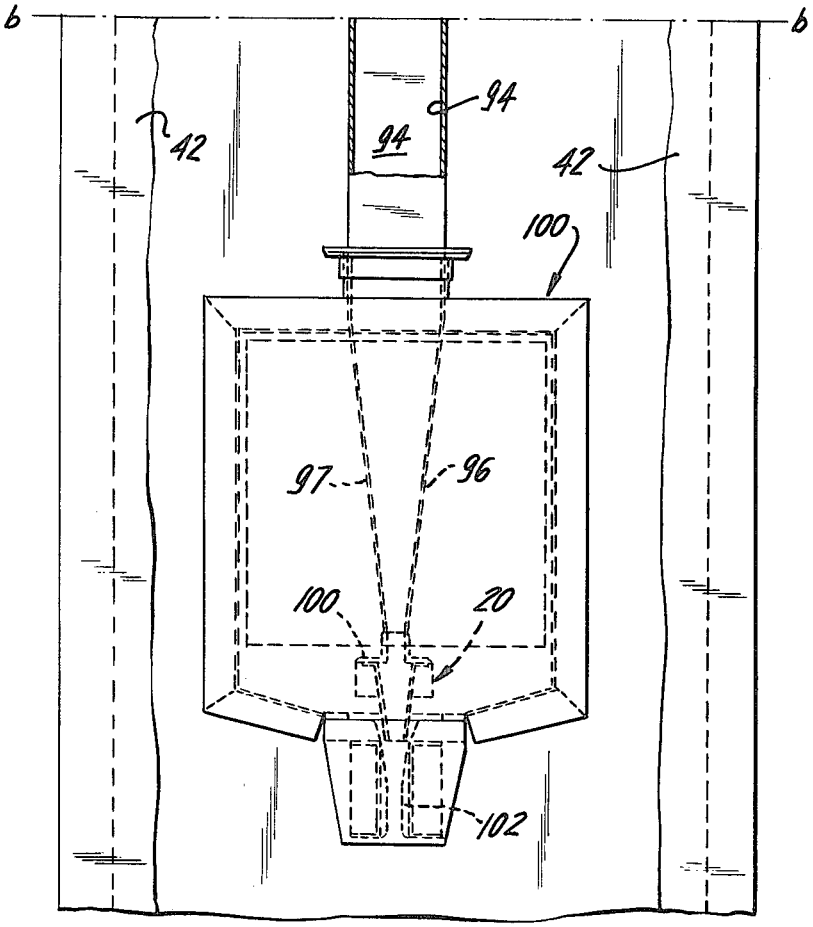
FIG. 3*a* is a side elevational view of the lower portion of the apparatus and joined to FIG. 3 along line b—b shown in FIGS. 3 and 3*a.*

The guide duct 18, in addition to a canted upper inlet portion 92 which defines inlet opening 90, comprises vertically supported contiguous walls defining an elongated passageway 94 through which the shot entering inlet opening 90 can free-fall. The lower end portion of guide duct 18 has opposite side wall portions and two opposite wall portions 96 and 98 which converge in a downward direction (see FIGS. 3*a* and 4) and are connected to nozzle assembly 20.

PLENUM ASSEMBLY

Figure 2A:
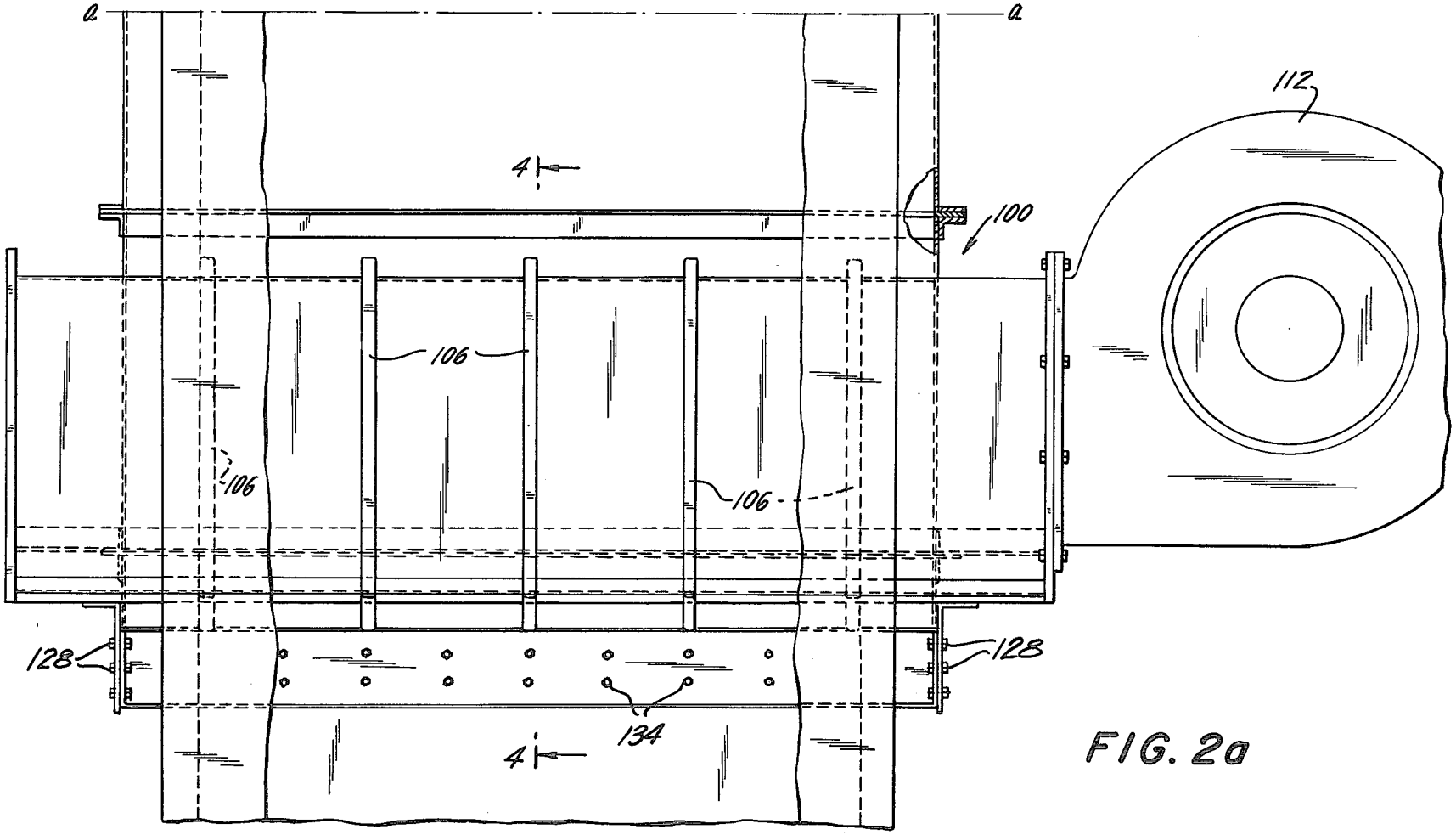
FIG. 2*a* is a front elevational view of the lower portion of the apparatus and joined to FIG. 2 substantially along line a—a shown in FIGS. 2 and 2*a;*
Figure 4:
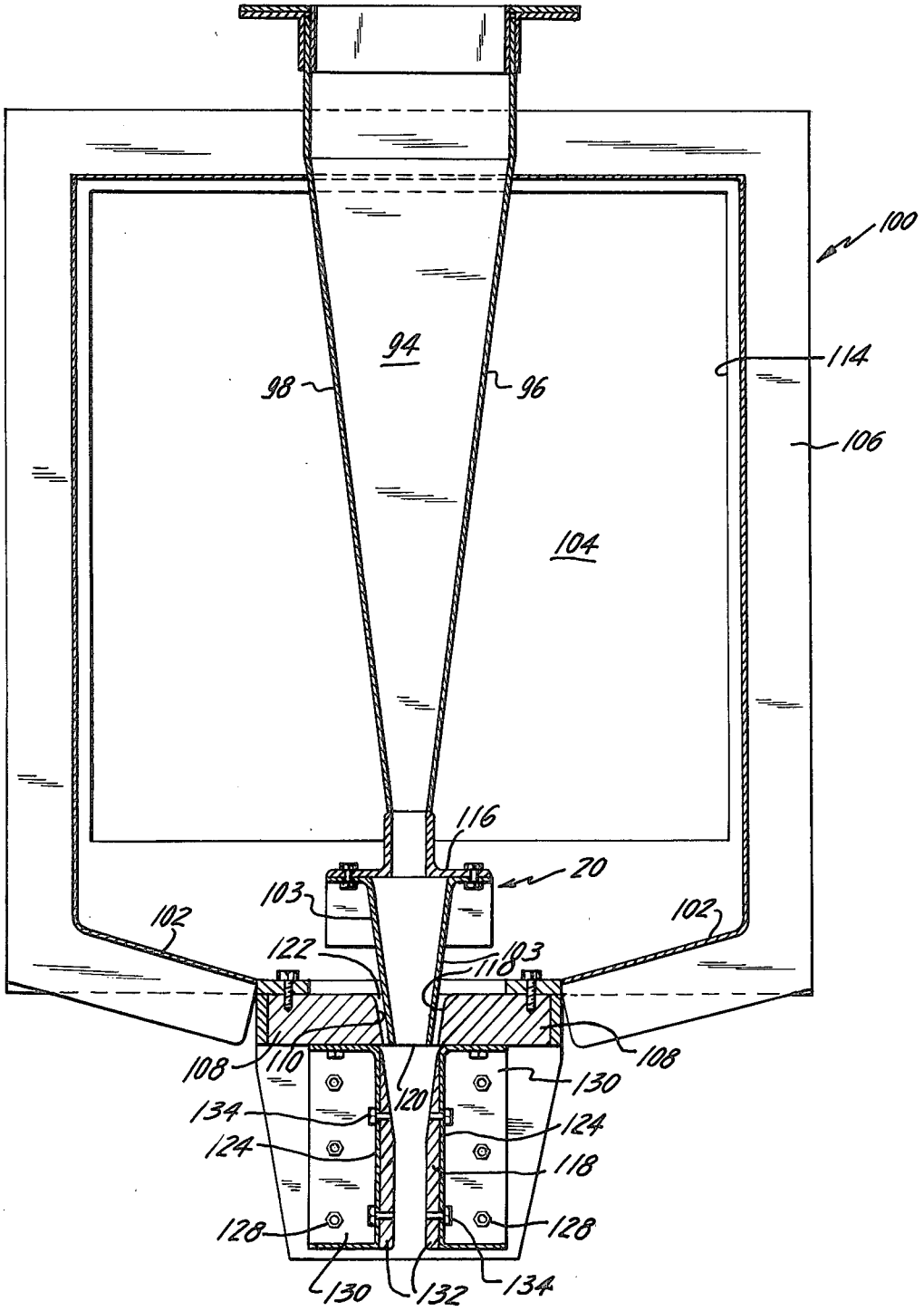
FIG. 4 is a cross-sectional view taken along line 4—4 of FIG. 2*a,* somewhat enlarged.

A plenum assembly 100 is disposed adjacent nozzle assembly 20. As best shown in FIGS. 2*a* and 4, plenum assembly 100 comprises four continuous vertical walls, a top wall and a bottom wall 102 to define therebetween a chamber 104 into which walls 96 and 98 of the lower portions of guide duct 18 extend. The walls of chamber 104 may be of relatively thin sheet metal reinforced by a plurality of peripherally disposed spaced, parallel ribs 106. The bottom wall 102 has attached thereto two spaced, thick plates 108. The juxtaposed adjacent side 110 of the respective plates are tapered to define therebetween a slot having walls converging in a downward direction. The plates 108 form part of nozzle assembly 20. As shown in FIG. 2*a*, an air blower 112 is secured, as by bolting, to one of the vertical walls so that the blower outlet is aligned with an opening 114 in that vertical wall (see FIG. 4). The air blower 112 is preferably of the variable speed, positive pressure type to provide a variable, relatively low static pressure, as for example of about 2 psi, in chamber 104.

NOZZLE ASSEMBLY

The nozzle assembly 20 comprises an inner nozzle section 116 and an outer nozzle section 118. The inner section 116 is connected to the end of guide duct 18 so as to be almost entirely disposed within chamber 104, while outer section 118 is disposed exteriorly of chamber 104 and is connected to the bottom wall 102 by way of plates 108. The inner nozzle section 116 consists of four continuous walls, with the two opposite, long walls 103 being arranged to converge toward each other in a downward direction to form a relatively narrow, elongated shot outlet 120. The walls of inner section 116 are so dimensioned that, when inner section 116 is attached to guide duct 18, it projects between and in spaced relationship with sides 110 of plates 108. Thus, inner nozzle section 116 and sides 110, define therebetween two air slots 122. The outer nozzle section 118 consists of two spaced U-shaped plates 124 which are secured to plates 108 and to two opposite end caps 126. The caps 126 are secured to plates 124 by bolts 128 in flanged ends 130 of the plates 124. To line the passageway between plates 124, wear liners 132 are secured to each of the juxtaposed surfaces of plates 124 by bolts or screws 134. The wear liners 132 have opposed surfaces so formed that the upper portions are coextensive with surfaces 110 and the lower portions extend in spaced parallel relationship.

The nozzle assembly 20 and plenum assembly 100 coact to provide a relatively low static air pressure in chamber 104, which air is accelerated in passage through air slots 122 from a relatively low velocity, as for example about 2,000 fpm entering slots 122 to about 20,000 fpm upon exiting slots 122. Since the air exits the slots immediately adjacent to shot outlet 120, the high velocity air entrains the shot exiting from shot outlet 120 and carries the shot out of the nozzle assembly 20 at a velocity greater than would occur by gravity acceleration of the shot alone.

FUNCTION OF THE SHOT PEENING APPARATUS

In the operation of apparatus 10 when a workpiece 22 is to be peened, hopper gate 58 is opened by actuation of linear motor 60. With gate 58 in the open position shown in broken lines, shot from hopper 12 flows through each of the metering valves 50 and into conduits 14 in the quantities as determined by adjustment of the metering valves. The shot falling through conduits 14 discharges at a velocity as determined by gravitational acceleration of the shot on to each of the deflector plates 78 (see FIG. 2). The deflector plates by reason of their shape and position utilizes the kinetic energy of the falling shot, to provide for random ricocheting of the shot into inlet 90 of guide duct 18. This random redirection of the shot upon impact with deflector plate 78 effects a substantially uniform distribution of shot across the width of guide duct 18. In guide duct 18, the shot is again accelerated by gravity and is discharged from inner nozzle section 116 through outlet 120 and is picked-up by air at relatively high velocity through and out of the outer nozzle section 118 as was previously described. The shot is driven toward and into impact with the surface of workpiece 22 which may be supported on a conveyor 24 or supported and/or conveyed during shot peening by any other suitable means, as for example a table, jig or rail supported table or car. The spent shot is collected in a collecting hopper 28 (see FIG. 1) and may, as is conventional, be recirculated back to supply hopper 12 by way of an elevator (not shown) and/or to a shot classifying system (not shown).

The velocity at which the shot is emitted from nozzle assembly 20 may be varied commensurate with the desired impact force with which the shot is to strike the workpiece. Obviously, workpieces 22 of different material may require different shot impact force. This ability to control the velocity of the discharging shot is accomplished by adjustment of the size of slots 122 to provide optimum performance and, since velocity is a function of air volume entering chamber 104 of plenum assembly 100, via air blower 112, by varying the speed of blower 112, the air velocity discharging from slots 122 can be adjusted and hence, the acceleration of the shot through and out of the nozzle assembly 20 can be varied.

It is now believed readily apparent from the foregoing description that the present invention provides a shot peening apparatus 10 which can be of smaller overall size than a similar apparatus which relies solely on gravitational acceleration of the shot to provide the desired impact force of the shot against a workpiece. It is an apparatus which has a wide range of utility since the impact force of the shot can be quickly and easily varied for different peening operations and workpiece materials. It is an apparatus which by reason of utilizing the force of gravity and low pressure air is less costly to operate than the conventional shot peening apparatuses which utilize a multiplicity of energy consuming high pressure nozzles and/or centrifugal throwing wheels.

Although but one embodiment of the invention has been illustrated and described in detail, it is to be understood that the invention is not limited thereto. Various changes can be made in the arrangement of parts without departing from the spirit and scope of the invention so the same will now be understood by those skilled in the art.

What is claimed is:

1. A shot peening apparatus for shot peening the surface of the workpiece comprising (a) guide duct means for receiving and conducting shot and having an upper inlet end portion and a lower outlet end portion;

(b) gravity feed means receiving shot from a source of supply thereof and for conveying and discharging shot by gravity;

(c) impact means interposed between the upper inlet end of said guide duct means and said gravity feed means which utilizes a portion of the kinetic energy of the shot discharging from the gravity feed means to effect substantially uniform distribution of the shot in the guide duct means; and (d) a nozzle means for receiving the substantially uniformly distributed shot from the guide duct means at gravitational velocity and for directing the shot to impact against a workpiece.

2. The apparatus of claim 1 wherein said gravity feed means comprises a plurality of side-by-side conduits connected at each of their respective upper ends to receive shot from a source of supply thereof and to convey the shot by gravity and discharge the shot from each of their respective lower ends.

3. The apparatus of claim 2 wherein said impact means is interposed between the upper inlet end of said guide duct means and the lower ends of said plurality of supply conduits.

4. The apparatus of claim 2 wherein said impact means comprises a baffle means having a deflecting surface for each of said conduits to cause the shot to randomly recochet into the upper inlet end portion of said guide duct means.

5. The apparatus of claim 1 wherein means is provided, adjacent said nozzle means, for forming a plenum containing a gaseous fluid at a low static pressure for accelerating the shot through said nozzle means.

6. A shot peening apparatus for shot peening the surface of a workpiece comprising:

(a) a guide duct, having an upper inlet end portion and a lower outlet end portion, for conducting shot;

(b) a plurality of spaced side-by-side shot conduits disposed above said guide duct and connected to receive at each of their respective upper ends shot from a source of supply thereof and to convey the shot by gravity and discharge the shot from each of their respective lower ends;

(c) an impact means interposed between the upper inlet end of said guide duct and the lower ends of said plurality of shot conduits which utilizes a portion of the kinetic energy of the shot discharging from the lower ends of said shot conduits to effect substantially uniform distribution of the shot in the upper inlet end of said guide duct; and (d) a nozzle means disposed adjacent the lower outlet end of said guide duct to receive said shot at gravitational velocity from said lower outlet end and direct the shot to impact against a workpiece.

7. The apparatus of claim 6 wherein said apparatus includes a means forming, adjacent said nozzle means, a plenum containing a gaseous fluid at low static pressure for accelerating the shot in a direction out of said nozzle means.

8. The apparatus of claim 7 wherein said nozzle means comprises the lower outlet end portion of said guide duct which is of elongated configuration so as to form an elongated opening for discharging shot therefrom and a wall means adjacent to and spaced from the lower outlet end portion of the guide duct to form juxtaposed dual gaseous fluid slots communicating with the plenum to receive the gaseous fluid from the latter and discharge the gaseous fluid at the elongated opening to effect acceleration of the shot discharging from such elongated opening.

9. The apparatus of claim 7 wherein said nozzle means has a venturi type configuration with a throat portion and passageways communicating the plenum with the throat portion.

10. The apparatus of claim 6 wherein a removable wear liner is provided in said nozzle means.

11. The apparatus of claim 6 wherein said impact means comprises a baffle means disposed so as to be impacted against by the shot discharging from the lower ends of the shot conduits and to cause the shot to randomly ricochet into the upper inlet end portion of said guide duct.

12. The apparatus of claim 11 wherein said baffle means comprises a plate associated with each of said shot conduits.

13. The apparatus of claim 12 wherein each plate is fan-shaped in planar view and arcuate in cross-section.

14. The apparatus of claim 12 wherein each plate has means for adjustment relative to the guide duct and for being fixed in a selected position.

* * * * *